United States Patent [19]

Shackelford

[11] 4,154,355

[45] May 15, 1979

[54] EVAPORATIVE COOLER LINERS

[76] Inventor: Leroy H. Shackelford, 300 Copper St., Superior, Ariz. 85273

[21] Appl. No.: 889,930

[22] Filed: Mar. 27, 1978

[51] Int. Cl.[2] ..... B65D 7/22

[52] U.S. Cl. ..... 220/4 B; 126/113; 220/DIG. 25; 261/DIG. 43

[58] Field of Search ..... 220/4 B, 4 E, DIG. 25, 220/4 F, 1 C; 62/285, 291; 312/228, 229; 52/593, 594; 261/DIG. 15, 29, DIG. 46, DIG. 43, DIG. 41; 126/113

[56] References Cited

U.S. PATENT DOCUMENTS

| | | | |
|---|---|---|---|
| 754,067 | 3/1904 | Hough | 52/593 |
| 1,121,597 | 12/1914 | Heckman | 220/4 B |
| 2,101,267 | 12/1937 | Nestler | 312/228 X |
| 2,620,722 | 12/1952 | Owens | 261/29 X |
| 2,721,451 | 10/1955 | Schumacher | 62/291 X |
| 3,126,428 | 3/1964 | Ash | 261/29 X |
| 3,261,897 | 7/1966 | Munk | 52/593 |
| 3,327,882 | 6/1967 | Andrews | 220/4 F |
| 3,456,927 | 7/1969 | Martin et al. | 261/DIG. 15 |
| 3,540,613 | 11/1970 | Hudson, Jr. | 220/4 F |
| 3,689,037 | 9/1972 | Payne | 261/DIG. 15 |

FOREIGN PATENT DOCUMENTS

| | | | |
|---|---|---|---|
| 1077880 | 8/1967 | United Kingdom | 220/4 E |

*Primary Examiner*—Allan N. Shoap
*Attorney, Agent, or Firm*—Warren F. B. Lindsley

[57] ABSTRACT

A pliable plastic liner for the water sumps of evaporative coolers comprising at least a pair of interconnecting parts which fit together in a manner forming a water tight seal.

2 Claims, 6 Drawing Figures

EVAPORATIVE COOLER LINERS

BACKGROUND OF THE INVENTION

With the advent of higher energy costs, the evaporative cooler as an air conditioning system is again assuming prominence in the marketplace. Its installation and operating costs are more economical then a refrigeration unit and even where a refrigeration system is needed the trend is now to utilize both types working together to provide an air conditioning system.

To eliminate some of the disadvantages of the evaporative cooler it is necessary to protect the evaporative cooler against the rust and corrosion effects of the water circulated therethrough.

PRIOR ART

At the present time, no known prior art exists directed to the use of plastic liners that are fitted into the base of evaporative coolers, i.e., its sump to protect the walls of the sump from rust and corrosion.

SUMMARY OF THE INVENTION

In accordance with the invention claimed, a new and improved plastic liner is provided which comprises one or more parts which may be assembled and fitted into and around the sump of an evaporative cooler before or after assembly in a water tight manner to protect the metal forming the sump from rust and corrosion.

It is, therefore, one object of this invention to provide a new and improved liner for the sump of an evaporative cooler.

Another object of this invention is to provide a new and improved liner for the sump of an evaporative cooler formed from interfitting parts which interlock in a water tight manner.

A further object of this invention is to provide a new and improved liner which surrounds the motor and rotating fan area of the evaporative cooler to provide plastic lined trough around the periphery of the base of the evaporative cooler.

A still further object of this invention is to provide a liner for the sumps of evaporative coolers which is easy to install, keep clean and replace while preventing or substantially reducing the present accepted rust and corrosion problems.

Further objects and advantages of the invention will become apparent as the following description proceeds and the features of novelty which characterize this invention will be pointed out with particularity in the claims annexed to and forming part of this specification.

DESCRIPTION OF THE PREFERRED EMBODIMENT

Figure 1:
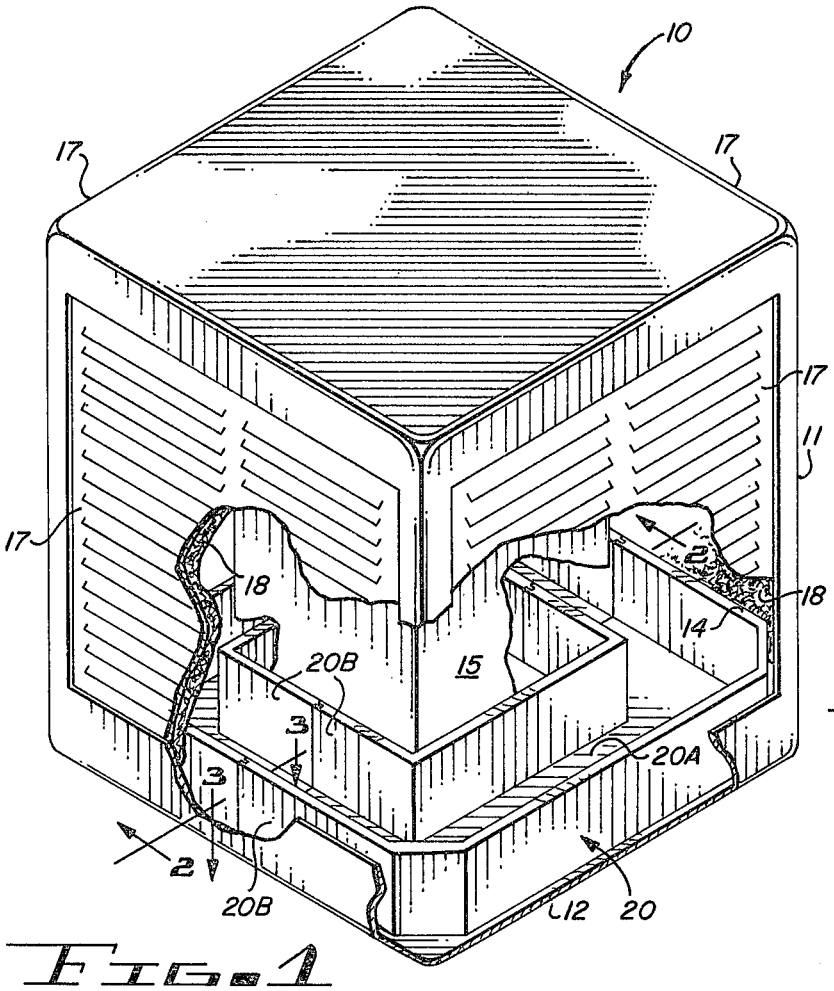
FIG. 1 is a perspective view, partially broken away, of an evaporative cooler illustrating the sump lined area of the evaporative cooler and embodying the invention.
Figure 3:
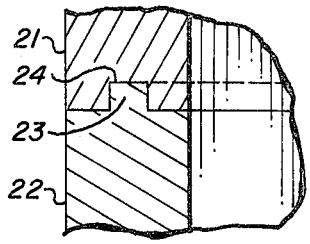
FIG. 3 is a cross-sectional view of FIG. 1 taken along the line 3—3.
Figure 2:
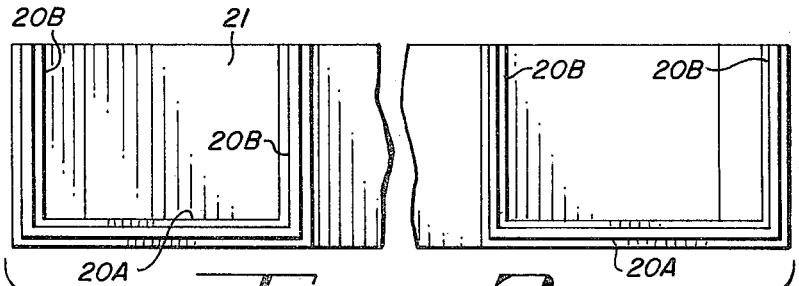
FIG. 2 is a cross-sectional view of FIG. 1 taken along the line 2—2.

Referring more particularly to the drawing by characters of reference, FIGS. 1–3 disclose an evaporative cooler 10 for an air conditioning system comprising a housing 11 forming in the base 12 thereof internally of the housing a sump 13. The sump may comprise, as shown in FIG. 1, a closed rectangular trough 14 which surrounds the center vertical section 15 of the housing which usually contains a blower (not shown).

The blower draws air into the housing through its slotted or grilled removable sides 17 and a plurality of evaporative water saturated cooler pads 18. One of the pads is mounted adjacent to or attached to each of the removable sides of the housing so that air drawn into the housing is cooled by the water saturated cooler pads. The blower than directs this cooled air usually through a duct system to the area to be cooled.

It should be noted that a given level of water is automatically contained in trough 14 and it is circulated each time the blower is energized to pump water contained therein to and across the tops of the pads wherein it soaks through the material of the pad wetting it substantially across the width and length of the pad. This wetting action cools the air drawn therethrough by the well known evaporative process.

In accordance with the invention claimed a new and improved liner 20 which may have a square or rectangular configuration is provided for fitting into and lining the trough forming the sump of the evaporative cooler 10. This liner as shown in FIG. 1 may comprise prefabricated and preformed mating parts each having a base 20A and laterally extending edges 20B which when placed in the trough may be interlocked together to form a water tight configuration.

FIGS. 1–3 illustrate that the liner may comprise two preformed U-shaped trough like parts 21 and 22 the open ends of which terminate in a common plane and are provided at their mating edges with a tongue 23 and groove 24 arrangement. The tongue and groove arrangement extend along the full length of the mating edges of parts 21 and 22.

Although the parts 21 and 22 of the liner 20 may be formed of any suitable liquid impervious rust resistant material, it should be noted that a number of rubber or plastic materials may be used which when molded form a smooth non-porous outer surface or skin. This material should be resilient enough so that the tongue and groove mating edges may fit together forming a water tight connection and seal for the mating parts.

Figure 5:
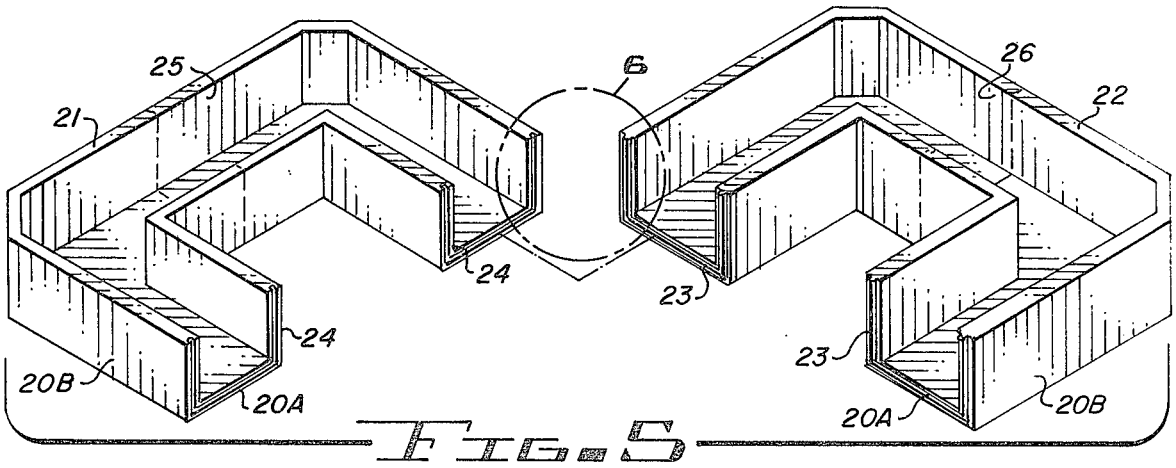
FIG. 5 is an exploded perspective view showing the trough illustrated in FIGS. 1–4 with the dash lines illustrating that the two piece liner of FIG. 1 may be made in four parts.

Although liner 20 shown in FIGS. 1, 2, 3, 5 and 6 comprises two mating parts, FIG. 5 illustrates by the dash lines 25 and 26 that the liner may be formed of four different right angular trough like parts with the mating edges of the parts at the dash lines in question formed by tongue and groove connections similar or identical to the tongue and grooves 23 and 24.

Figure 4:
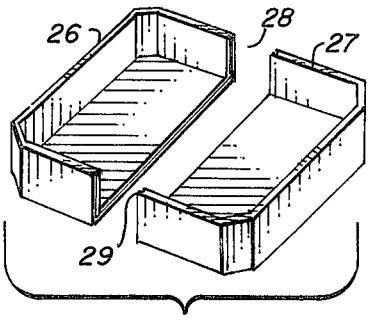
FIG. 4 illustrates a modification of the liner shown in FIGS. 1–3.
Figure 6:
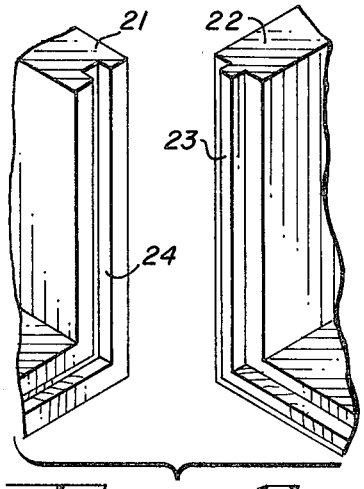
FIG. 6 is an enlarged view of the circled portion of the interlocking tongue and groove engaging edges of the structure shown in FIG. 5.

In order to form a liner for the evaporative coolers which have an open base so that the sump comprises an open trough, a liner 25, shown in FIG. 4, is provided comprising two mating parts 26 and 27. The mating edges 28 and 29 of this liner are provided with the tongue 23 and grooves 24 configuration hereto described for the liner shown in FIGS. 1, 3, 3, 5 and 6.

Although but one embodiment of the invention has been shown and claimed, it will be apparent to those skilled in the art that various changes and modifications may be made therein without departing from the spirit of the invention or from the scope of the appended claims.

What is claimed is:

1. An article forming a liner for the sump of an evaporative cooler comprising:

at least a pair of preformed parts, all parts being formed of a resilient plastic material, each part comprising a flat base and side members extending laterally thereof in the same direction around a first portion of said base, a second portion of said base and the free ends of said side members forming mating edges of said parts which when engaged in an interlocking manner form a flat configuration, the mating edges of said parts having a tongue and groove configuration for interconnecting said parts in a water tight arrangement to form a water holding tray, said parts each comprise a U-shaped trough the open ends of which terminate in a common plane, the connected parts forming a tray having a central opening surrounded by a peripheral inner wall, a peripheral outer wall spaced from and parallel to said inner wall, and a peripheral water holding trough between said inner and outer walls.

2. The article set forth in claim 1 wherein:

said parts each comprise two pairs of open-ended right angular troughs the mating ends of which terminate in a common plane.

* * * * *